US011946259B2

(12) United States Patent
Walker et al.

(10) Patent No.: US 11,946,259 B2
(45) Date of Patent: Apr. 2, 2024

(54) RAILING SYSTEM FOR STAIRS

(71) Applicant: Peak Innovations Inc., Richmond (CA)

(72) Inventors: Simon Walker, Delta (CA); Craig Lawson, Burnaby (CA); Charles Young, Vancouver (CA)

(73) Assignee: Peak Innovations Inc., Richmond (CA)

( * ) Notice: Subject to any disclaimer, the term of this patent is extended or adjusted under 35 U.S.C. 154(b) by 241 days.

(21) Appl. No.: 17/286,775

(22) PCT Filed: Oct. 22, 2019

(86) PCT No.: PCT/CA2019/051494
§ 371 (c)(1),
(2) Date: Apr. 19, 2021

(87) PCT Pub. No.: WO2020/082172
PCT Pub. Date: Apr. 30, 2020

(65) Prior Publication Data

US 2021/0372132 A1 Dec. 2, 2021

Related U.S. Application Data

(60) Provisional application No. 62/748,755, filed on Oct. 22, 2018.

(51) Int. Cl.
*E04F 11/18* (2006.01)

(52) U.S. Cl.
CPC ..... *E04F 11/1817* (2013.01); *E04F 11/1842* (2013.01); *E04F 2011/1821* (2013.01)

(58) Field of Classification Search
CPC . E04F 2011/1872; E04F 11/18; E04F 11/181; E04F 11/1817; E04F 11/1842; E04F 2011/1868; E04F 2011/1823; E04F 2011/1825; E04F 2011/1827; E04H 17/1439
See application file for complete search history.

(56) References Cited

U.S. PATENT DOCUMENTS 3,258,251 A * 6/1966 Culter ..... E04F 11/181 256/22
3,352,541 A * 11/1967 Wenzel ..... E04F 11/1812 52/832

(Continued)

FOREIGN PATENT DOCUMENTS

CH 389876 A * 3/1965
DE 102012107008 A1 * 2/2014 ..... E04F 11/1802

(Continued)

*Primary Examiner* — Jonathan P Masinick
(74) *Attorney, Agent, or Firm* — OYEN WIGGS GREEN

(57) ABSTRACT

A railing system for stairs comprises a plurality of pickets, a first rail, and a second rail. The first rail comprises a handle portion, an attachment portion, and a first cover. The attachment portion is attached to the pickets using fasteners. The first cover is adapted to cover the fasteners when the attachment portion is attached to the pickets. The second rail comprises a base member, a base sidewall, and a second cover. The base member comprises a plurality of base openings adapted to receive the pickets. The base sidewall is attached to the pickets using fasteners. The second cover is adapted to fit over the fasteners when base sidewall is attached to the pickets.

12 Claims, 10 Drawing Sheets

(56) References Cited

U.S. PATENT DOCUMENTS

| | | | | | |
|---|---|---|---|---|---|
| 3,918,686 | A * | 11/1975 | Knott | E04F 11/181 | 256/22 |
| 6,029,954 | A | 2/2000 | Murdaca | | |
| 6,039,307 | A * | 3/2000 | De Zen | E04H 17/1439 | 256/66 |
| 6,425,676 | B1 * | 7/2002 | Lyons | G02B 6/0091 | 362/240 |
| 6,752,385 | B2 | 6/2004 | Zen et al. | | |
| 7,635,115 | B2 * | 12/2009 | Lehmann | E04H 17/1447 | 256/22 |
| 8,511,648 | B2 * | 8/2013 | McCarthy | E04H 17/168 | 256/65.01 |
| 8,695,948 | B2 * | 4/2014 | Stinson | E04F 11/1817 | 256/64 |
| 11,186,996 | B2 * | 11/2021 | Springborn | E04F 11/1838 | |

FOREIGN PATENT DOCUMENTS

| | | | | |
|---|---|---|---|---|
| DE | 202014105038 | | 3/2016 | |
| DE | 202014105038 | U1 * | 3/2016 | E04F 11/1836 |
| FR | 1110157 | A * | 2/1956 | |
| GB | 768322 | A * | 2/1957 | |
| WO | 2017/045056 | | 3/2017 | |
| WO | WO-2017045056 | A1 * | 3/2017 | E04F 11/1842 |

* cited by examiner

RAILING SYSTEM FOR STAIRS

FIELD OF THE INVENTION

The present invention relates to railing systems, and in particular, to railing systems for use with stairs.

BACKGROUND OF THE INVENTION

Railing systems for any number of outdoor applications are well known. For example, residential decks, pool decks, and playgrounds all utilize any number of conventional railing systems. Such railing systems typically comprise a top and bottom longitudinal rails, with a number of vertical pickets spanning between the rails.

However, conventional railing systems are often difficult to install, especially when a portion of the railing system involves stairs. Because the top and bottom rails are now oriented at an angle, it is often difficult to install the pickets (which would typically remain vertical) within the rails.

Therefore, it is desirable for a railing system for use with stairs that is easy to install and yet physically secure.

SUMMARY OF THE INVENTION

A railing system in accordance with the present invention comprises a plurality of pickets, a first rail, and a second rail. Each of the pickets have first and second ends and comprises a picket first opening proximate to the first end and a picket second opening proximate to the second end.

The first rail comprises a handle portion, an attachment portion, and a first cover. The handle portion is adapted to be gripped by a user. The attachment portion is connected to the handle portion and comprises an attachment sidewall in contact with at least a portion of the pickets. The attachment sidewall comprises a plurality of attachment openings corresponding in location to the picket first openings. The attachment openings and the corresponding picket first openings are adapted to receive fasteners. The first cover is adapted to cover the fasteners when the fasteners are inserted into the attachment openings and the corresponding picket first openings.

The second rail comprises a base member, a base sidewall, and a second cover. The base member comprises a plurality of base openings adapted to receive the second ends of the pickets. The base sidewall extends from the base member and is in contact with at least a portion of the pickets. The base sidewall comprises a plurality of base sidewall openings corresponding in location to the picket second openings. The base sidewall openings and the corresponding picket second openings are adapted to receive other ones of the fasteners. The second cover is adapted to fit over the other ones of the fasteners when the other ones of the fasteners are inserted into the base sidewall openings and the corresponding picket second openings.

According to another embodiment, the attachment portion further comprises an enclosure for holding one or more accessories.

According to still another embodiment, the enclosure comprises an elongated slit opening.

According to still yet another embodiment, the attachment portion further comprises a second attachment sidewall in contact with another portion of the pickets.

According to a further embodiment, the attachment sidewall and the second attachment sidewall are arranged substantially parallel to each other.

According to still a further embodiment, the attachment portion comprises a channel, with the first cover adapted to fit substantially within the channel.

According to still yet a further embodiment, the second rail comprises a channel, with the channel being defined, at least in part, by the base sidewall.

According to yet a further embodiment, the second cover is adapted to fit substantially within the channel.

According to another embodiment, a railing system comprises a plurality of pickets, a first rail, and a second rail. Each of the pickets have first and second ends and comprises a picket opening proximate to the first end. The first rail comprises a handle portion, an attachment portion, and a cover. The handle portion is adapted to be gripped by a user. The attachment portion is connected to the handle portion and comprises an attachment sidewall in contact with at least a portion of the pickets. The attachment sidewall comprises a plurality of attachment openings corresponding in location to the picket openings. The attachment openings and the corresponding picket openings are adapted to receive fasteners. The cover is adapted to cover the fasteners when the fasteners are inserted into the attachment openings and the corresponding picket openings. The second rail is configured to receive the second ends of the pickets.

According to yet another embodiment, a railing system comprises a plurality of pickets, a first rail, and a second rail. Each of the pickets have first and second ends and comprises a picket opening proximate to the second end. The first rail comprises a handle portion adapted to be gripped by a user and an attachment portion adapted to receive the first ends of the pickets. The second rail comprises a base member, a base sidewall, and a cover. The base member comprises a plurality of base openings adapted to receive the second ends of the pickets. The base sidewall extends from the base member and is in contact with at least a portion of the pickets. The base sidewall comprises a plurality of base sidewall openings corresponding in location to the picket openings. The base sidewall openings and the corresponding picket openings are adapted to receive fasteners. The cover is adapted to fit over the fasteners when the fasteners are inserted into the base sidewall openings and the corresponding picket openings.

The foregoing was intended as a summary only and of only some of the aspects of the invention. It was not intended to define the limits or requirements of the invention. Other aspects of the invention will be appreciated by reference to the detailed description of the preferred embodiments.

BRIEF DESCRIPTION OF THE DRAWINGS

The embodiments of the invention will be described by reference to the drawings thereof, in which.

DETAILED DESCRIPTION OF THE INVENTION

Figure 1:
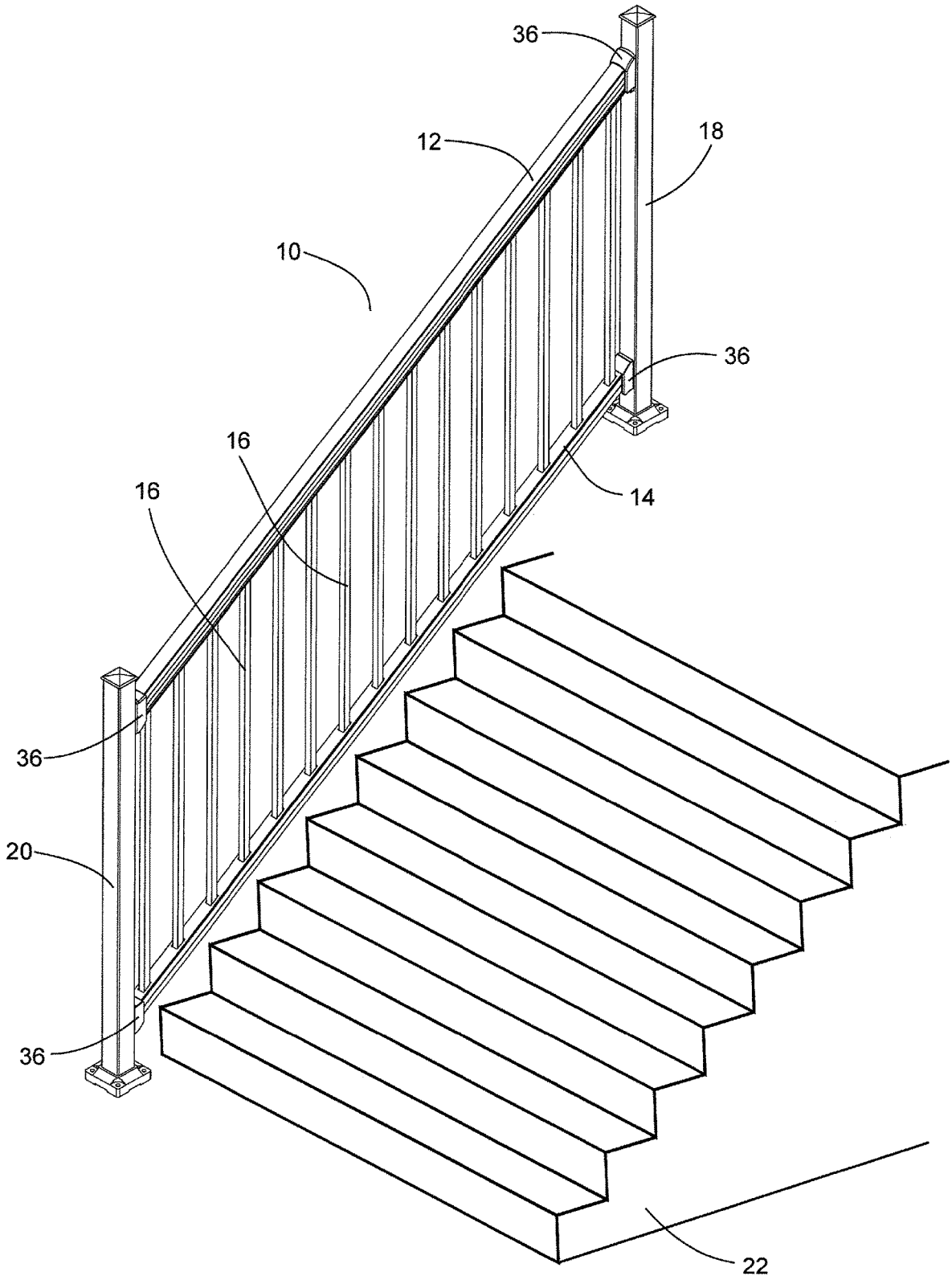
FIG. 1 is a perspective view of the railing system in accordance with the invention.

Referring to FIG. 1, a railing system 10 in accordance with the present invention is generally shown. The railing system 10 comprises an elongated first rail 12, an elongated second rail 14, and a plurality of pickets 16 extending between the first rail 12 and the second rail 14. The first rail 12 and the second rail 14 are attached to upper and lower posts 18, 20, using brackets 36. The upper post 18 and the lower post 20 are preferably substantially vertical and are preferably located proximate to the upper and lower parts, respectively, of stairs 22.

Figure 3:
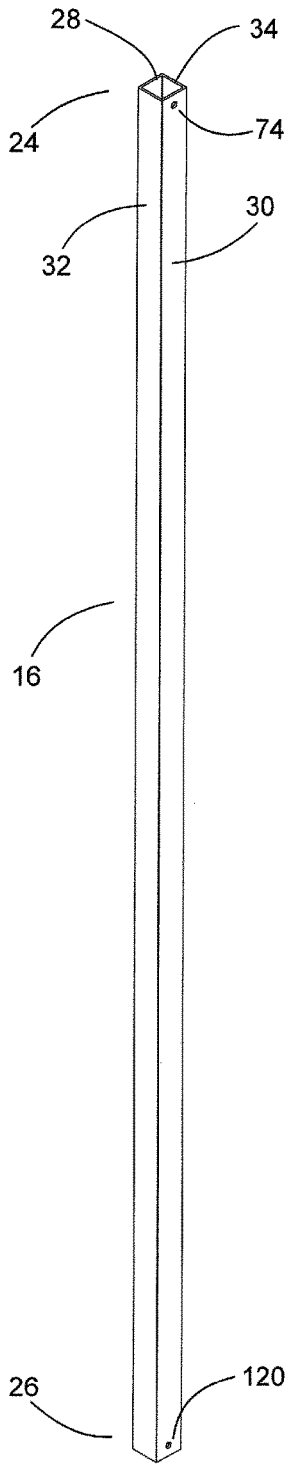
FIG. 3 is a perspective view of one of the pickets of the railing system of FIG. 1.

As the railing system 10 is intended to be used with the stairs 22, the first rail 12 and the second rail 14 are preferably oriented at an angle with respect to the horizontal. Preferably, this angle is similar to that of the pitch of the stairs 22. The first rail 12 and the second rail 14 may be substantially parallel to each other. Preferably, the pickets 16 are oriented substantially vertically in a spaced arrangement along a length of the first and second rails 12, 14. Referring to FIG. 3, each of the pickets 16 comprises picket upper end 24 and picket lower end 26. In one embodiment, the pickets 16 have a generally rectangular cross-section, with each picket 16 comprising picket first sidewall 28, picket second sidewall 30, picket third sidewall 32, and picket fourth sidewall 34 extending between the picket upper and lower ends 24, 26. In this embodiment, the picket first and second sidewalls 28, 30 are arranged parallel to each other, while the picket third and fourth sidewalls 32, 34 are arranged parallel to each other. However, it is understood that other shapes and configurations for the pickets 16 are also available. For example, in another embodiment, the pickets 16 may have a generally circular or elliptical cross-section. In another embodiment, the pickets 16 may comprise more than four sidewalls.

Figure 2:
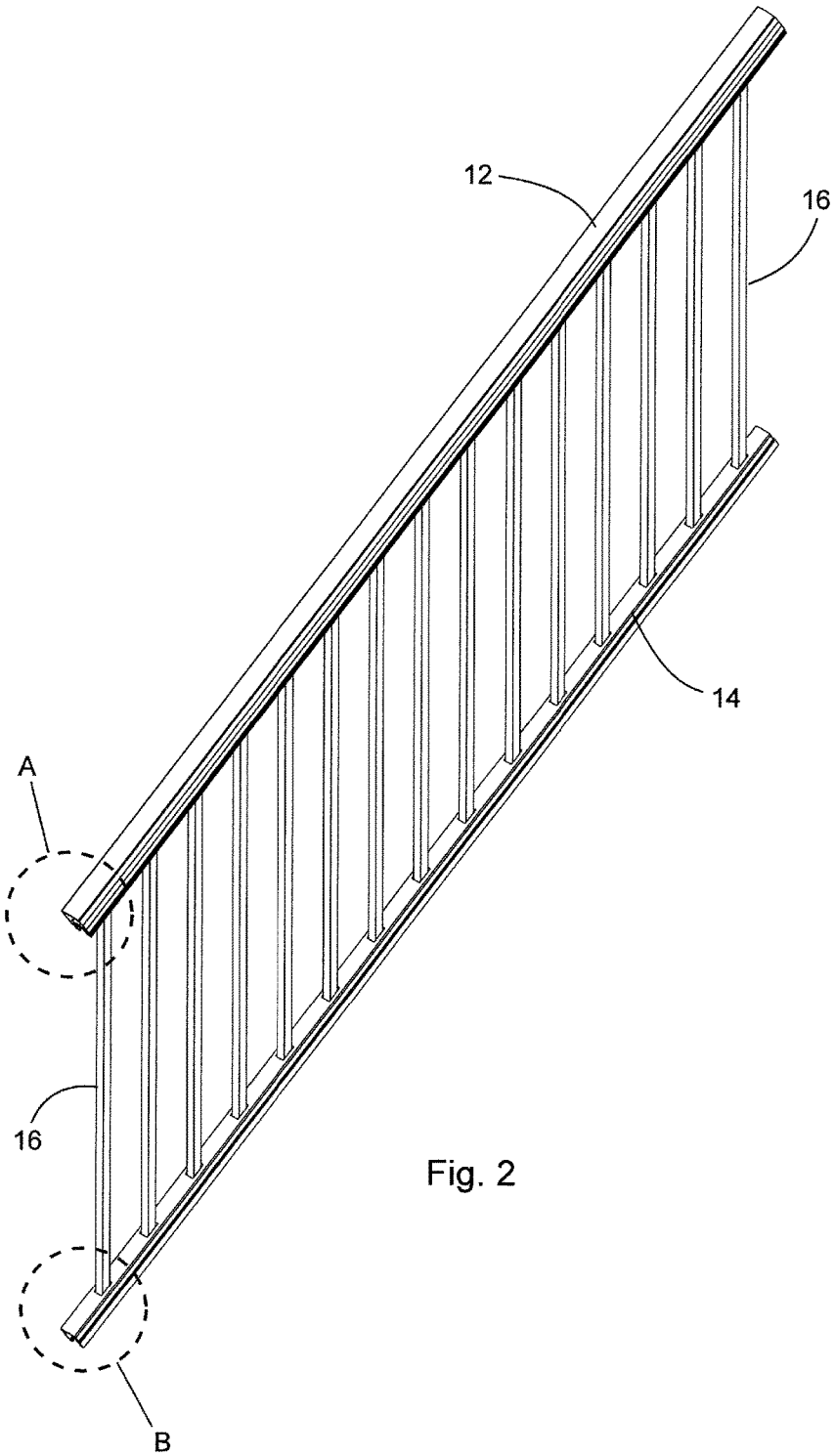
FIG. 2 is a partial perspective view of the railing system of FIG. 1 showing the first rail, the second rail, and the pickets.
Figure 4:
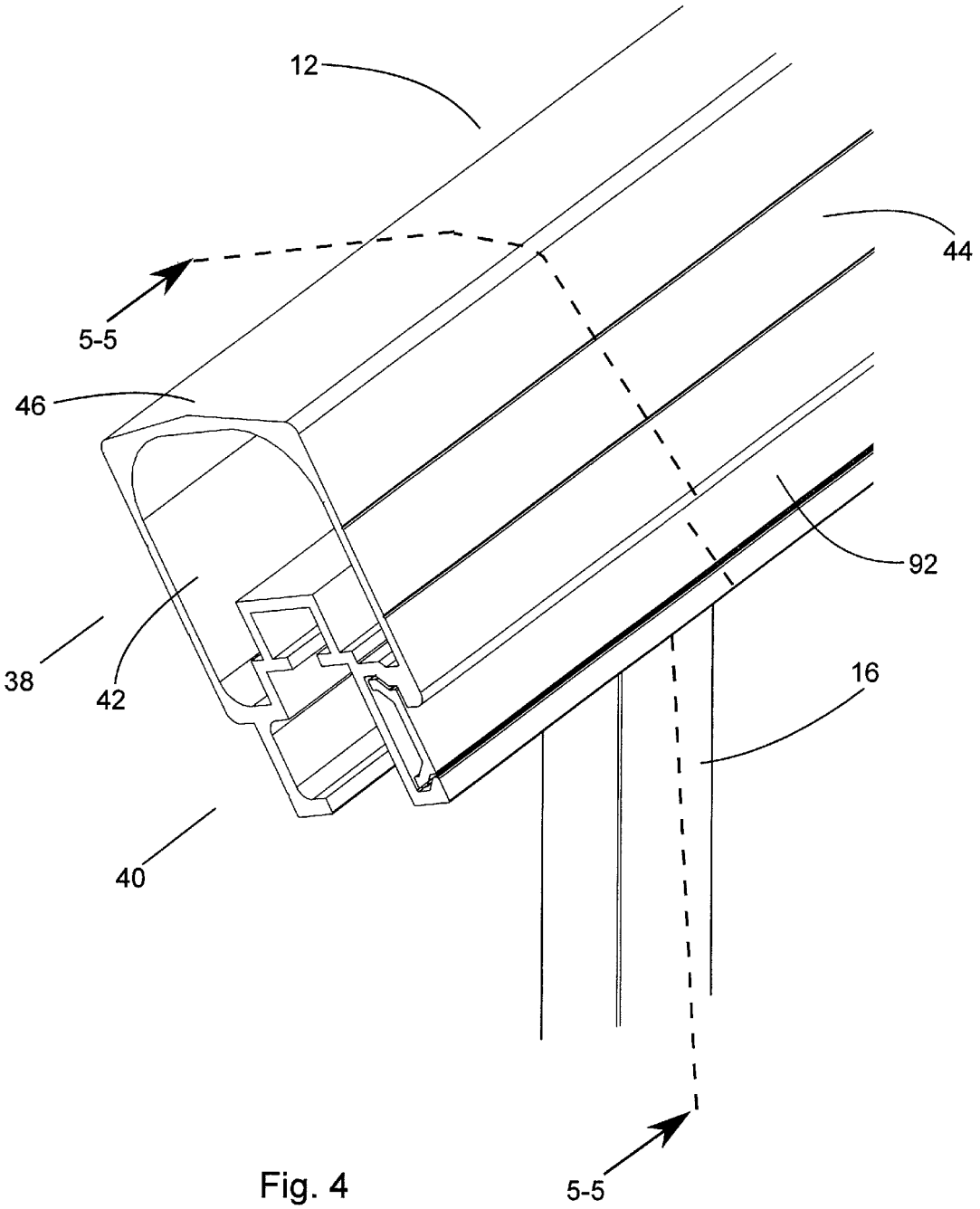
FIG. 4 is an enlarged view of the portion of FIG. 2 depicted as A.
Figure 6:
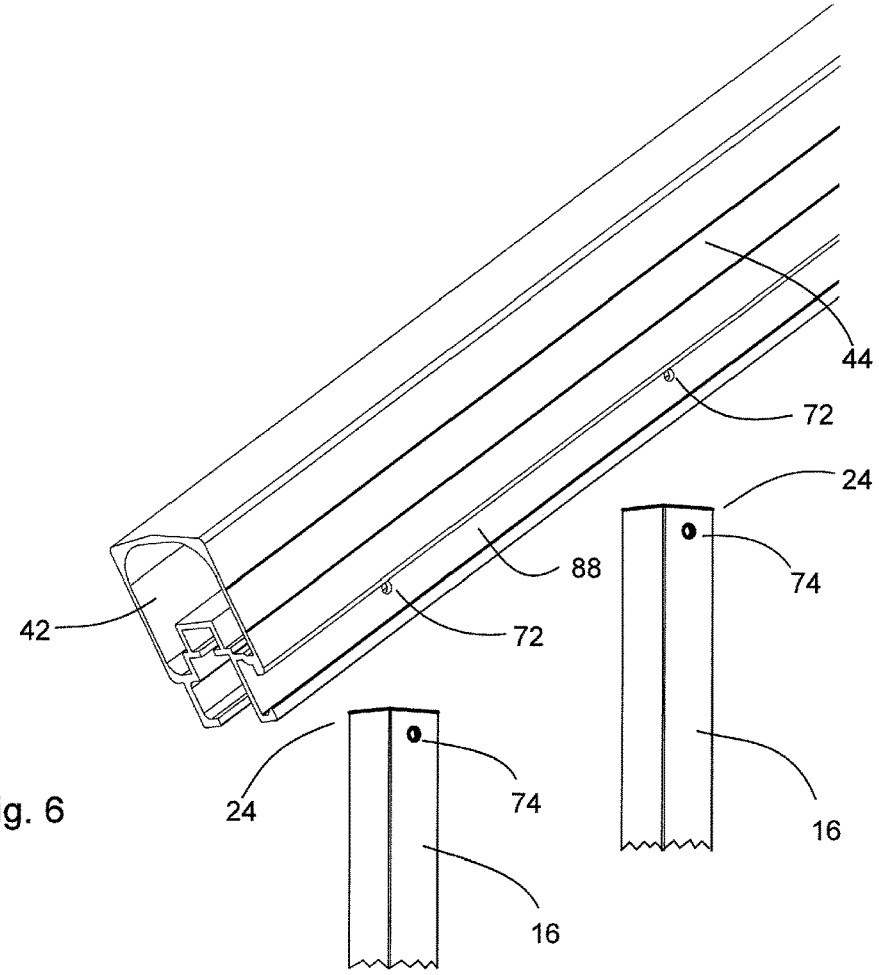
FIG. 6 is an partial exploded view of FIG. 2 showing the first rail and two pickets.
Figure 7:
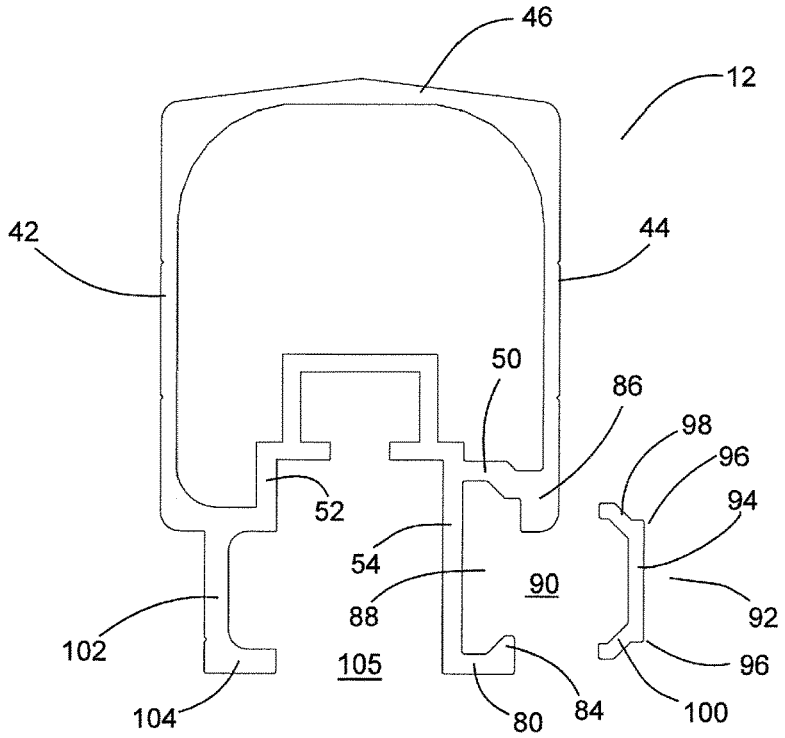
FIG. 7 is a front view of the first rail.

FIG. 2 depicts a partial view of the railing system 10, without the upper and lower posts 18, 20 and the brackets 36. Referring generally to FIG. 4 (which is an enlarged partial view of FIG. 2) and FIGS. 5 to 7, the first rail 12 comprises an elongated handle portion 38 and an elongated attachment portion 40. The handle portion 38 is generally adapted to be gripped by a user of the railing system and may take on various shapes and configurations. In the embodiment shown in FIGS. 4 to 7, the handle portion 38 comprises handle first and second sidewalls 42, 44, with a handle upper member 46 extending between the handle first and second sidewalls 42, 44. Although the embodiment shown in FIGS. 4 to 7 depicts the handle first and second sidewalls 42, 44 as being generally planar, it is understood that the handle first and second sidewalls 42, 44 may be curved or comprise rounded sections for ergonomic or ornamentation purposes. Similarly, although FIG. 7 depicts the handle upper member 46 as having an angled surface, it is understood that the handle upper member 46 may have a surface that is curved, rounded, planar, or otherwise suitably shaped. It is also possible that the handle upper member 46 be omitted if, for example, the first and second handle sidewalls 42, 44 are curved such that they meet together (without the need for the handle upper member 46 to extend between them).

The attachment portion 40 is adapted to engage with the picket upper ends 24 of the pickets 16 and preferably extends between the handle first and second sidewalls 42, 44. In the embodiment shown in FIGS. 4 to 7, the attachment portion 40 may comprise elongated first and second wing members 48, 50 extending generally inwardly from the handle first and second sidewalls 42, 44, respectively. Preferably, the first and second wing members 48, 50 extend inward for a distance such that the picket upper ends 24 are still able to pass between the first and second wing members 48, 50. In particular, where the pickets 16 have a generally rectangular cross-section, the distance between the first and second wing members 48, 50 is at least as great as the distance between the picket first and second sidewalls 28, 30. Preferably, the distance between the first and second wing members 48, 50 is approximately the same as the distance between the picket first and second sidewalls 28, 30.

Figure 5:
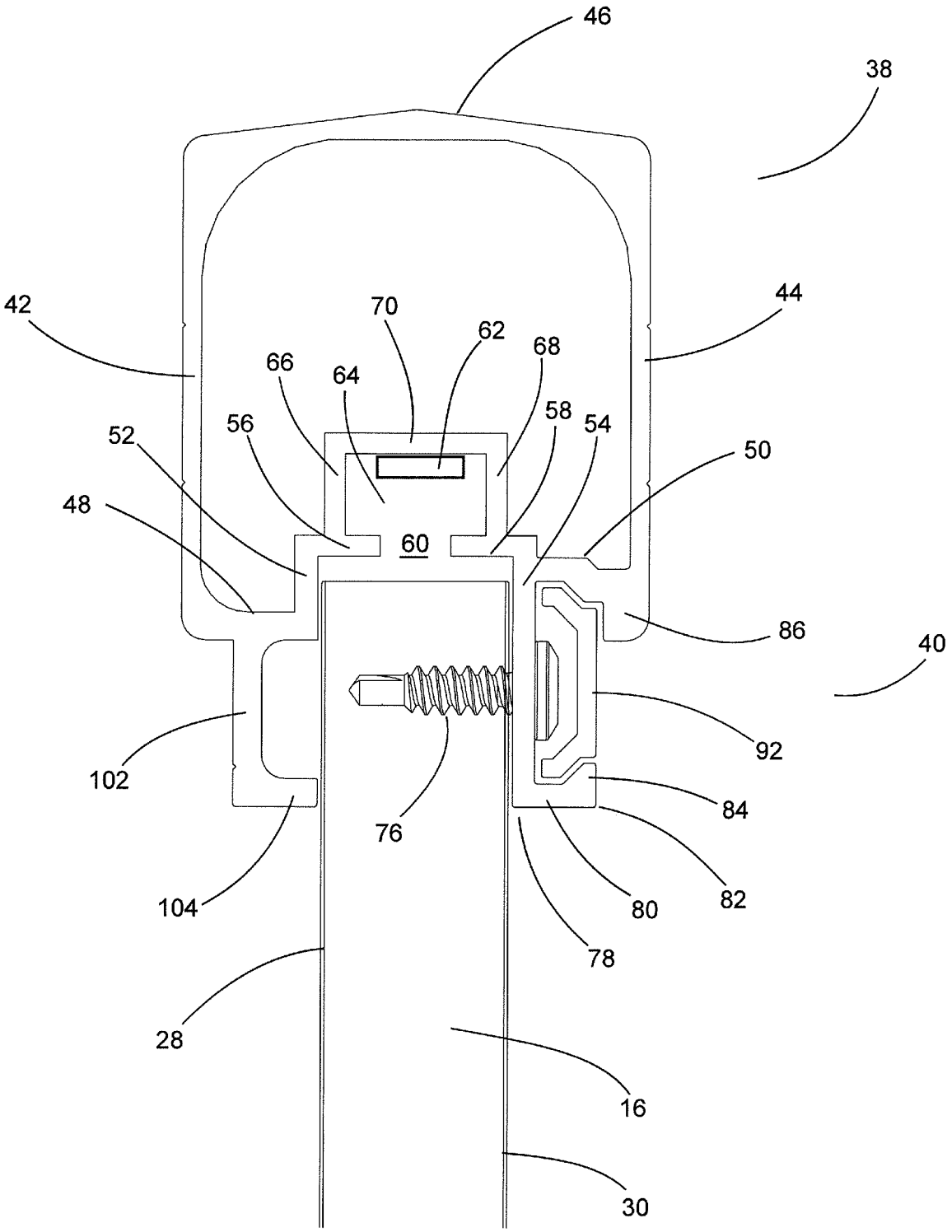
FIG. 5 is a sectional view of FIG. 4 taken along 5-5.

Referring to FIG. 5, first and second engagement members 52, 54 preferably extend from the first and second wing members 48, 50, respectively. In the embodiment shown in FIGS. 4 to 7, the first and second engagement members 52, 54 are adapted to engage with at least a portion of the picket first and second sidewalls 28, 30, respectively, thereby ensuring that the pickets 16 fit snugly between the first and second engagement members 52, 54.

Referring again to FIG. 5, first and second upper members 56, 58 extend inwardly from the first and second engagement members 52, 54, respectively, preferably n a substantially perpendicular orientation to the first and second engagement members 52, 54. The first and second upper members 56, 58 are situated above the picket upper end 24 and define an elongated slit opening 60. In another embodiment, it is also possible for the first and second upper members 56, 58 to be replaced by a single member that extends between the first and second engagement members 52, 54. In this embodiment, the slit opening 60 would not be present.

The attachment portion 40 may also be adapted to hold one or more accessories 62, such as lighting strips. The accessories 62 may be held within an enclosure 64 situated above the first and second upper members 56, 58. Referring to FIG. 5, the enclosure 64 is defined, at least in part, by an enclosure first sidewall 66, an enclosure second sidewall 68, an enclosure upper member 70, and portions of the first and second upper members 56, 58. The enclosure first and second sidewalls 66, 68 extend from the first and second upper members 56, 58, while the enclosure upper member 70 extends between the enclosure first and second sidewalls 66, 68. In the embodiment shown in FIGS. 4 to 7, the enclosure 64 is in the form of a generally rectangular box.

The accessories 62 may be inserted into the enclosure 64 through the slit opening 60. In addition, in the case where the accessories 62 comprise lighting strips, the slit opening 60 also serves to allow for light to be transmitted through it.

Referring to FIG. 7, the second engagement member 54 may have a greater height than the first engagement member 52. In other words, the distance that the second engagement member 54 extends along the picket second sidewall 30 may be greater than the distance that the first engagement member 52 extends along the picket first sidewall 28. The second engagement member 54 comprises one or more attachment openings 72 spaced along a longitudinal length of the second engagement member 54. Each of the attachment openings 72 is adapted to correspond with a picket upper opening 74 located on the pickets 16. The picket upper opening 74 is preferably located on the picket second sidewall 30 and proximate to the picket upper end 24. The attachment openings 72 and the picket upper openings 74 are both adapted to receive fasteners 76 for securing the pickets 16 to the first rail 12. The fasteners 76 may be screws, bolts, rivets, or the like.

Referring to FIG. 7, the second engagement member 54 comprises a lower edge 78, with an elongated ledge 80 extending outwardly from the second engagement member 54, preferably proximate to the lower edge 78. The ledge 80 may comprise an outer ledge edge 82, with an elongated raised ridge 84 extending from the ledge edge 82. In addition, an overhang 86 may extend from the second wing member 50, with the overhang 86 being spaced apart from the second engagement member 54.

An elongated upper channel 88 is provided, with the upper channel 88 being defined, at least in part, by the overhang 86, the second wing member 50, at least a portion of the second engagement member 54, the ledge 80, and the ridge 84. As shown in FIG. 6, the attachment openings 72 are located on a portion of the second engagement member 54 that is within the upper channel 88. An upper channel opening 90 is defined by the overhang 86 and the ridge 84. The upper channel opening 90 provides access to the attachment openings 72 so that the fasteners 76 may be attached.

The upper channel 88 is adapted to receive an elongated upper channel cover 92 that covers the upper channel opening 90. This serves to hide the fasteners 76 from view. Preferably, the upper channel cover 92 extends for substantially an entire length of the first rail 12, as shown in FIG. 2; however, it is also possible that the upper channel cover 92 only extends for a portion of the length of the first rail 12. It is also possible that a plurality of upper channel covers 92 be provided, with each of the upper channel covers 92 extending for a portion of the length of the first rail 12.

Referring to FIG. 7, the upper channel cover 92 is preferably adapted to cover the upper channel 88. In the embodiment shown in FIG. 7, the upper channel cover 92 comprises a substantially planar central member 94 with longitudinal edges 96 and first and second lateral members 98, 100 extending from the longitudinal edges 96. The first and second lateral members 98, 100 preferably extend from the central member 94 at an angle or in some other way such that the first and second lateral members 98, 100 are not coplanar with the central member 94. As shown in FIG. 5, the upper channel cover 92 is preferably securely held in place within the upper channel 88 through the interaction of the upper channel cover 92 with one or more of the overhang 86, the second wing member 50, the ledge 80, and the ridge 84.

For example, in the embodiment shown in FIGS. 4 to 7, the overhang 86 may be configured to engage with the central member 94, thus preventing the upper channel cover 92 from falling out of the upper channel opening 90. In another embodiment, the first lateral member 98 may be configured to engage with the overhang 86. Similarly, the second lateral member 100 may be configured to engage with at least one of the ledge 80 or the ridge 84, thus preventing the upper channel cover 92 from sliding down the picket second sidewall 30.

Referring to FIG. 5, the attachment portion 40 may also comprise an attachment sidewall 102 extending from the first wing member 48. Preferably, the attachment sidewall 102 extends substantially perpendicularly from the first wing member 48 and is spaced apart from the picket first sidewall 28. An attachment shelf 104 may also extend inwardly from the attachment sidewall 102. Preferably, the attachment shelf 104 extends such that it contacts the picket first sidewall 28, providing a brace or support for the pickets 16 to prevent the pickets 16 from wobbling. As shown in FIG. 7, the attachment shelf 104 and the ledge 80 preferably define an elongated attachment opening 105 for receiving the picket upper ends 24 of the pickets 16.

Figure 8:
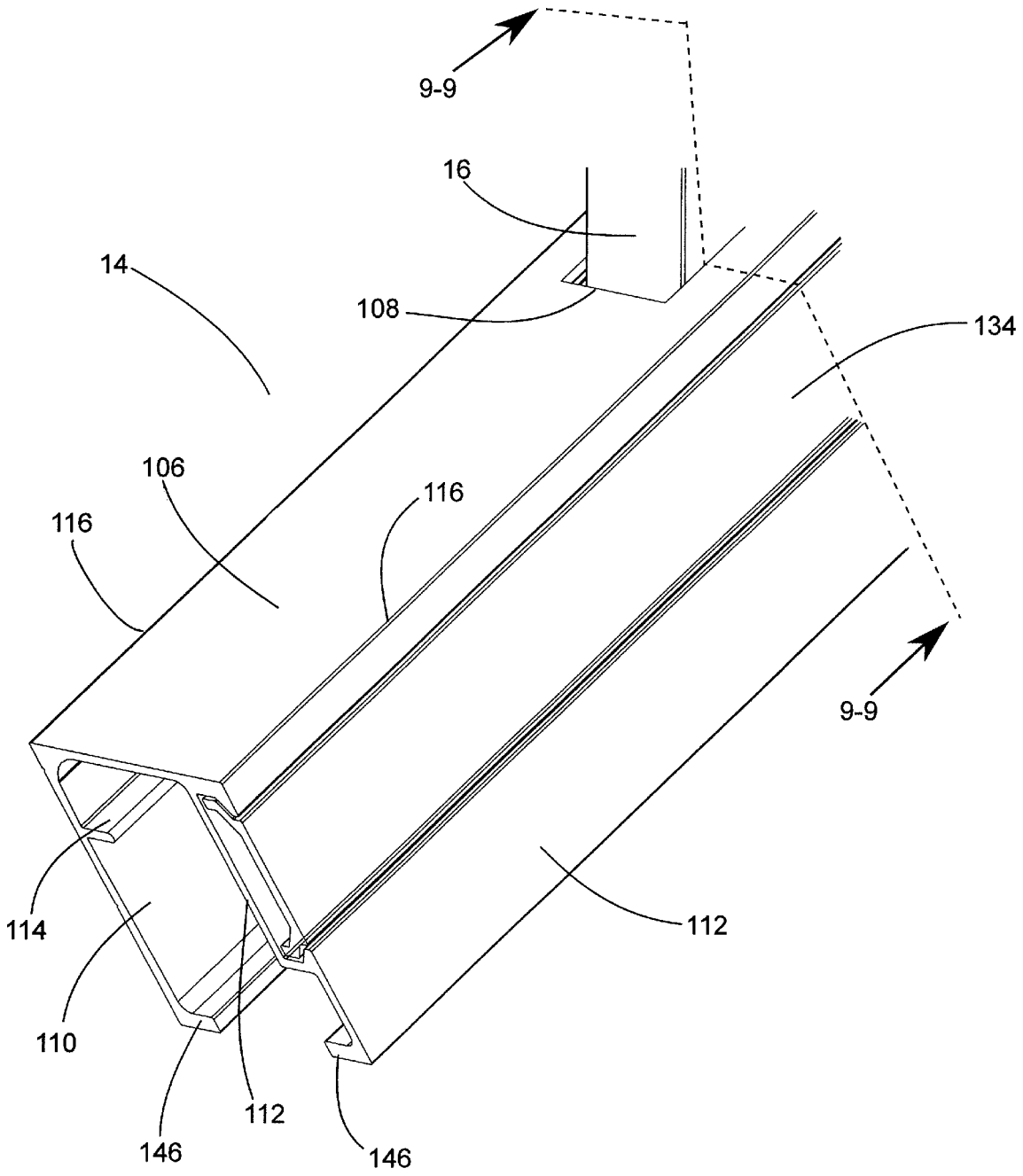
FIG. 8 is an enlarged view of the portion of FIG. 2 depicted as B.

Referring to FIG. 8 (which is an enlarged partial view of FIG. 2) and FIGS. 9 to 11, the second rail 14 comprises an elongated base member 106 with one or more base openings 108 formed thereon. The base openings 108 are adapted to receive the picket lower ends 26 of the pickets 16. The base member 106 comprises base longitudinal edges 116. The second rail 14 further comprises elongated base first sidewall 110 and elongated base second sidewall 112, both of which preferably extend substantially perpendicularly from the base member 106. The base first and second sidewalls 110, 112 are preferably parallel to the picket first and second sidewalls 28, 30. In the embodiment shown in FIGS. 8 to 11, the base first sidewall 110 extends from the base member 106 proximate to one of the base longitudinal edges 116 and is spaced apart from the picket first sidewall 28. A base shelf 114 may extend from the base first sidewall 110 toward the picket first sidewall 28.

The base second sidewall 112 preferably extends from the base member 106 at a distance away from one of the base longitudinal edges 116. Preferably, the base second sidewall 112 engages with and is substantially flush with at least a portion of the picket second sidewall 30. The base second sidewall 112 comprises one or more base sidewall openings 118 spaced along a longitudinal length of the base second sidewall 112. Each of the base sidewall openings 118 is adapted to correspond with a picket lower opening 120 located on the pickets 16. The picket lower opening 120 is preferably located on the picket second sidewall 30 and proximate to the picket lower end 26. The base sidewall openings 118 and the picket lower openings 120 are both adapted to receive the fasteners 76 for securing the pickets 16 to the second rail 14.

In the embodiment shown in FIGS. 8 to 11, a base ledge 122 extends outwardly from the base second sidewall 112. The base ledge 122 may comprise an outer base ledge edge 124, with an elongated raised base ridge 126 extending from the base ledge edge 124. In addition, a base overhang 128 may extend from the base member 106, with the base overhang 128 being spaced apart from the base second sidewall 112.

Figure 10:
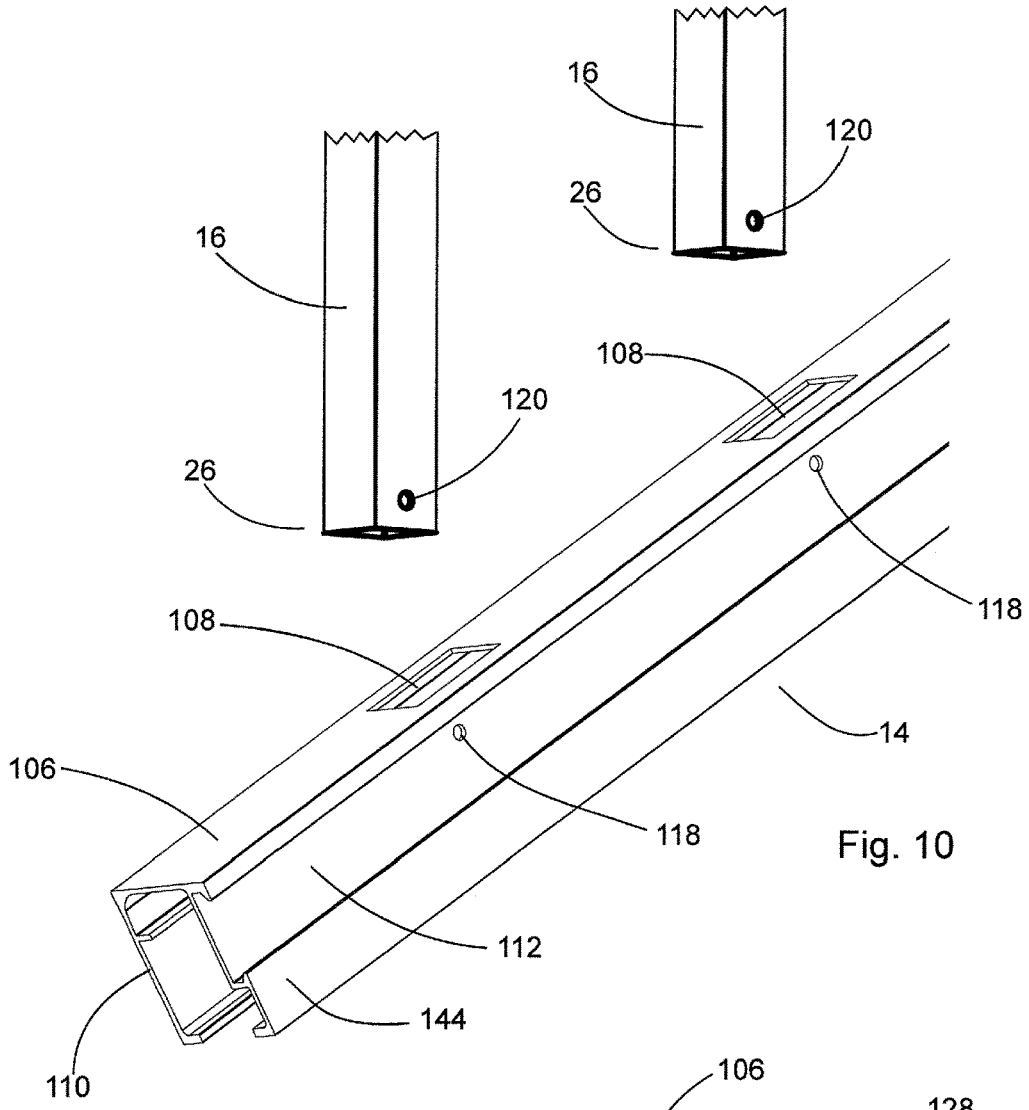
FIG. 10 is a partial exploded view of FIG. 2 showing the second rail and two pickets.

An elongated lower channel 130 is provided, with the lower channel 130 being defined, at least in part, by the base overhang 128, at least a portion of the base member 106, at least a portion of the base second sidewall 112, the base ledge 122, and the base ridge 126. As shown in FIG. 10, the base sidewall openings 118 are located on the base second sidewall 112 within the lower channel 130. A lower channel opening 132 is defined by the base overhang 128 and the base ridge 126. The lower channel opening 132 provides access to the base sidewall openings 118 so that the fasteners 76 may be attached.

The lower channel 130 is adapted to receive an elongated lower channel cover 134.

The lower channel cover 134 may be similar to the upper channel cover 90 or they may be different, depending on the respective dimensions of the lower channel 130 and the upper channel 88. In one embodiment, the lower channel cover 134 may be interchangeable with the upper channel cover 90.

The lower channel cover 134 servers to hide the fasteners 76 from view. Preferably, the lower channel cover 134 extends for substantially an entire length of the second rail 14, as shown in FIG. 2; however, it is also possible that the lower channel cover 134 only extends for a portion of the length of the second rail 14. It is also possible that a plurality of lower channel covers 134 be provided, with each of the lower channel covers 134 extending for a portion of the length of the second rail 14.

Figure 9:
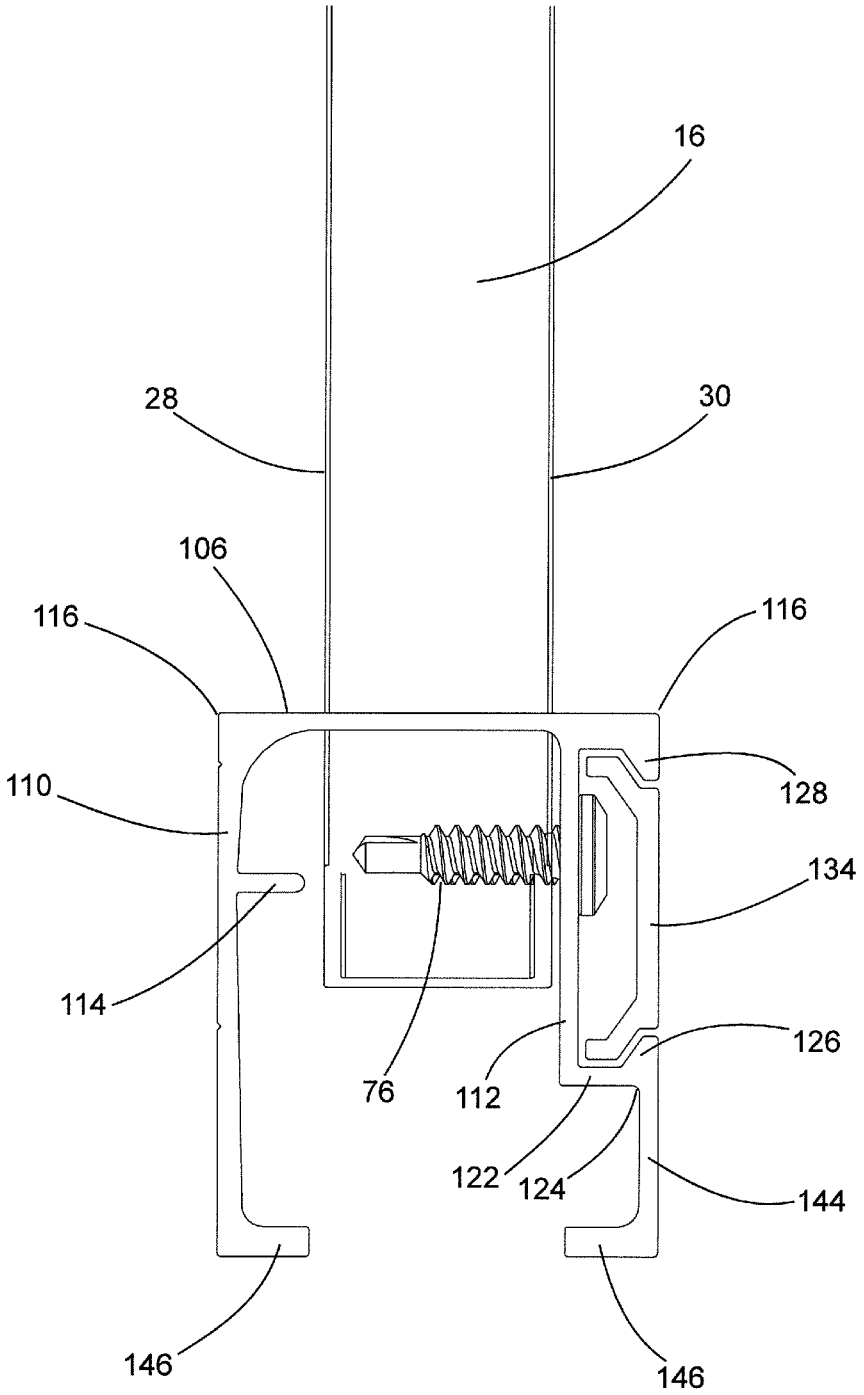
FIG. 9 is a sectional view of FIG. 8 taken along 9-9.
Figure 11:
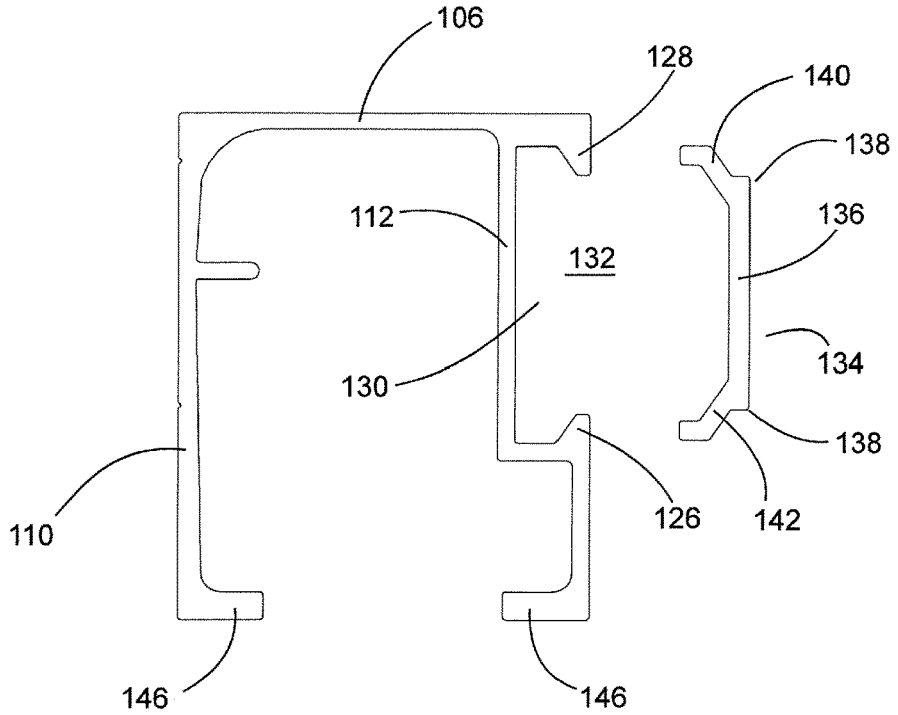
FIG. 11 is a front view of the second rail.

Referring to FIG. 11, the lower channel cover 134 is preferably adapted to cover the lower channel 130. In the embodiment shown in FIGS. 8 to 11, the lower channel cover 134 comprises a substantially planar lower central member 136 with lower longitudinal edges 138 and lower first and second lateral members 140, 142 extending from the lower longitudinal edges 138. The lower first and second lateral members 140, 142 preferably extend from the lower central member 136 at an angle or in some other way such that the lower first and second lateral members 140, 142 are not coplanar with the lower central member 136. As shown in FIG. 9, the lower channel cover 134 is preferably securely held in place within the lower channel 130 through the interaction of the lower channel cover 134 with one or more of the base overhang 128, the base member 106, the base ledge 122, and the base ridge 126.

For example, in the embodiment shown in FIGS. 8 to 11, the base overhang 128 may be configured to engage with the lower first lateral member 140, while the base ridge 126 may be configured to engage with the lower second lateral member 142. This interaction prevents the lower channel cover 134 from falling out of the lower channel opening 134. In another embodiment, the base overhang 128 or the base ridge 126 may instead engage with the lower central member 136.

Referring to FIG. 9, an elongated base leg 144 may extend from the base ledge 122. For example, the base leg 144 may extend from the base ledge 122 proximate to the base ledge edge 124. An elongated base feet member 146 may extend inwardly from one or both of the base first sidewall 110 and the base leg 144. In the embodiment shown in FIGS. 8 to 11, base feet member 145 extends from both the base first sidewall 110 and the base leg 144, with the base leg 144 configured such that the two base feet member 146 are at substantially the same level.

The upper and lower channel covers 92, 134 also serve to protect the fasteners 76 respectively from the elements (in addition to hiding them from view).

Figure 12:
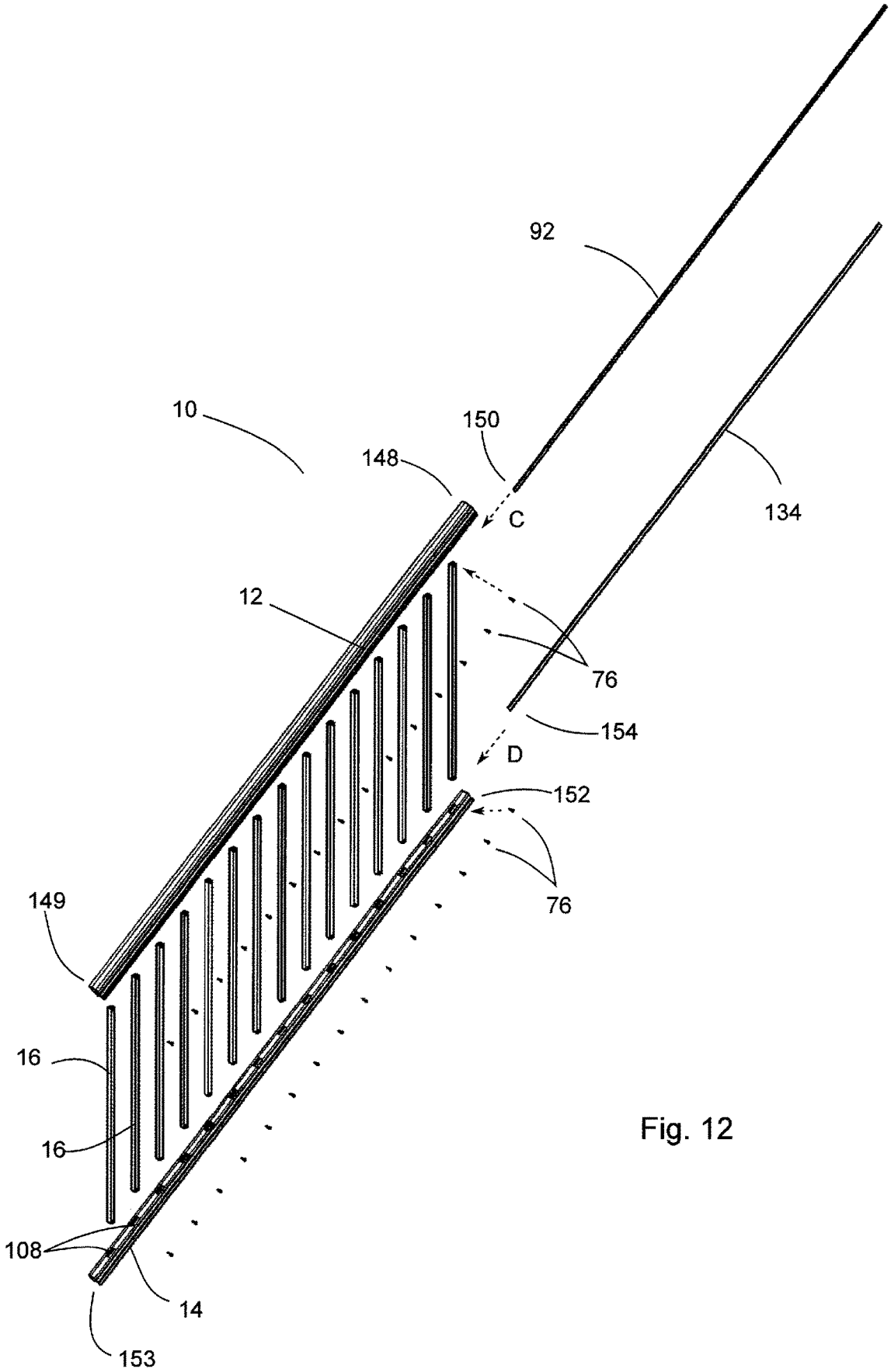
FIG. 12 is an exploded view of FIG. 2.

Referring to FIG. 12, the railing system 10 may be installed in the following manner. The first rail 12 and second rail 14 are first placed on the ground. The picket upper ends 24 of the pickets 16 are inserted through the attachment opening 105 of the first rail 12. The pickets 16 are placed along the first rail 12 such that each of the picket upper openings 74 is aligned with one of the attachment openings 72. The fasteners 76 are then inserted through both the picket upper openings 74 and the attachment openings 72 to secure the pickets 16 to the first rail 12.

The upper channel cover 92 can then be inserted to cover the upper channel 88. For example, it may be necessary to manually deflect the first and second lateral members 98, 100 slightly in order for the upper channel cover 92 to fit through the upper channel opening 90. After the upper channel cover 92 has passed through the upper channel opening 90, the first and second lateral members 98, 100 may be released from their deflected state and allowed to revert to their original configuration. By reverting to their original configuration, the upper channel cover 92 is no longer able to exit from the upper channel 88 and is thus held in place.

Alternatively, the upper channel cover 92 may be slid into upper channel 88. For example, an upper cover end 150 of the upper channel cover 92 may be slid through an upper first end 148 of the attachment portion 40 (e.g. in direction C, as shown in FIG. 12) until the upper cover end 150 reaches an upper second end 149 of the attachment portion 40.

Next, the picket lower ends 26 are inserted into the second rail 14 through the base openings 108. The pickets 16 are arranged such that each of the picket lower openings 120 is aligned with one of the base sidewall openings 118. The fasteners 76 are then inserted through both the picket lower openings 120 and the base sidewall openings 118 to secure the pickets 16 to the second rail 14.

The lower channel cover 134 can then be inserted to cover the lower channel 130. For example, it may be necessary to manually deflect the lower first and second lateral members 140, 142 slightly in order for the lower channel cover 134 to fit through the lower channel opening 132. After the lower channel cover 134 has passed through the lower channel opening 132, the lower first and second lateral members 140, 142 may be released from their deflected state and allowed to revert to their original configuration. By reverting to their original configuration, the lower channel cover 134 is no longer able to exit from the lower channel 130 and is thus held in place.

Alternatively, the lower channel cover 134 may be slid into lower channel 130. For example, a lower cover end 154 of the lower channel cover 134 may be slide through a lower first end 152 of the second rail 14 (e.g. in direction D, as shown in FIG. 12) until the lower cover end 154 reaches a lower second end 153 of the second rail 14.

At this point, the first rail 12, the second rail 14, and the pickets 16 are now secured in place as a single unit. It can then be attached to the upper and lower posts 18, 20 using the brackets 36 to complete the railing system 10.

Figure 13:
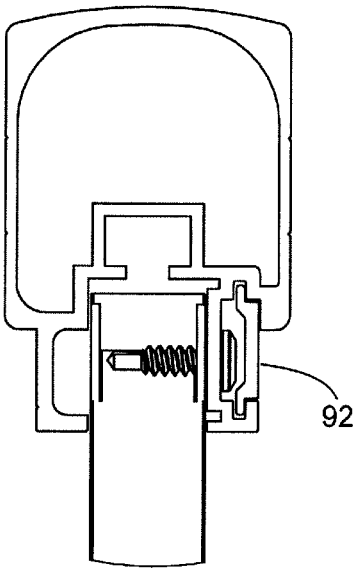
FIG. 13 is a partial sectional view of the railing system in accordance with another embodiment.
Figure 14:
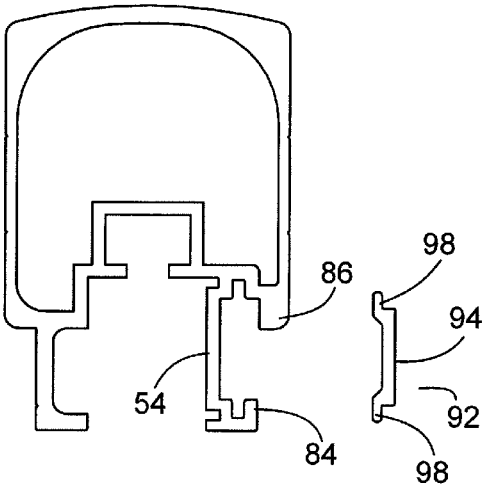
FIG. 14 is a front view of the first rail of the embodiment in FIG. 13.

FIGS. 13 to 16 depict another embodiment of the railing system 10. Referring to FIGS. 13 and 14, in this embodiment, the configuration of the upper channel cover 92 is somewhat different from that shown in FIGS. 4 to 7. In particular, the first and second lateral members 98, 100 have a stepped arrangement with respect to the central member 94. In other words, although the first and second lateral members 98, 100 are substantially parallel to the central member 94, the first and second lateral members 98, 100 are generally offset from the central member 94 (as best seen in FIG. 14). Accordingly, the configuration of the overhang 86 and the ridge 84 have been modified to accommodate the upper channel cover 92 of this embodiment.

Figure 15:
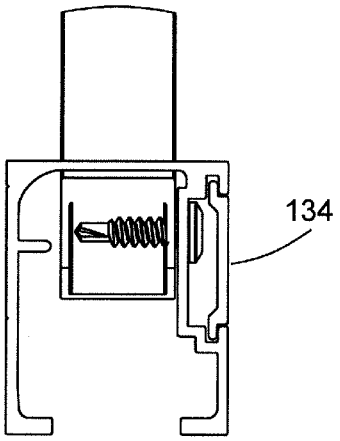
FIG. 15 is a partial sectional view of the railing system in accordance with yet another embodiment.
Figure 16:
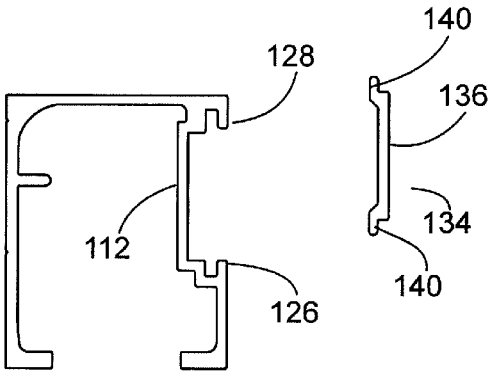
FIG. 16 is a front view of the second rail of the embodiment in FIG. 15.

Referring to FIGS. 15 and 16, the configuration of the lower channel cover 134 is also somewhat different from that shown in FIGS. 8 to 11. In particular, the lower first and second lateral members 140, 142 have a stepped arrangement with respect to the lower central member 136. In other words, although the lower first and second lateral members 140, 142 are substantially parallel to the lower central member 136, the lower first and second lateral members 140, 142 are generally offset from the lower central member 136 (as best seen in FIG. 16). Accordingly, the configuration of the base overhang 128 and the base ridge 126 have been modified to accommodate the lower channel cover 134 of this embodiment.

It will be appreciated by those skilled in the art that the preferred embodiment has been described in some detail but that certain modifications may be practiced without departing from the principles of the invention.

The invention claimed is:

1. A railing system for stairs, comprising:

a plurality of pickets, each of the pickets having first and second ends and comprising:

a picket first opening proximate to the first end; and a picket second opening proximate to the second end;

a first rail comprising:

a handle portion adapted to be gripped by a user;

an attachment portion connected to the handle portion, the attachment portion comprising:

a first channel;

an attachment sidewall in contact with at least a portion of the pickets, wherein the attachment sidewall comprises a plurality of attachment openings corresponding in location to the picket first openings, and wherein the attachment openings and the corresponding picket first openings are adapted to receive fasteners; and an overhang spaced apart from the attachment sidewall; and a first cover adapted to cover the fasteners when the fasteners are inserted into the attachment openings and the corresponding picket first openings, wherein the first cover is adapted to fit substantially within the first channel, and wherein the overhang is adapted to extend over at least a portion of the first cover; and a second rail comprising:

a base member comprising a plurality of base openings adapted to receive the second ends of the pickets;

a base sidewall extending from the base member, the base sidewall in contact with at least a portion of the pickets, wherein the base sidewall comprises a plurality of base sidewall openings corresponding in location to the picket second openings, and wherein the base sidewall openings and the corresponding picket second openings are adapted to receive other ones of the fasteners; and a second cover adapted to cover the other ones of the fasteners when the other ones of the fasteners are inserted into the base sidewall openings and the corresponding picket second openings.

2. The railing system of claim 1, wherein the attachment portion further comprises an enclosure for holding one or more accessories.

3. The railing system of claim 2, wherein the enclosure comprises an elongated slit opening.

4. The railing system of claim 1, wherein the attachment portion further comprises a second attachment sidewall in contact with another portion of the pickets.

5. The railing system of claim 4, wherein the attachment sidewall and the second attachment sidewall are arranged substantially parallel to each other.

6. The railing system of claim 1, wherein the second rail comprises a second channel, and wherein the second channel is defined, at least in part, by the base sidewall.

7. The railing system of claim 6, wherein the second cover is adapted to fit substantially within the second channel.

8. A railing system for stairs, comprising:

a plurality of pickets, each of the pickets having first and second ends and comprising a picket opening proximate to the first end;

a first rail comprising:

a handle portion adapted to be gripped by a user;

an attachment portion connected to the handle portion, the attachment portion comprising:

a channel;

an attachment sidewall in contact with at least a portion of the pickets, wherein the attachment sidewall comprises a plurality of attachment openings corresponding in location to the picket openings, and wherein the attachment openings and the corresponding picket openings are adapted to receive fasteners; and an overhang spaced apart from the attachment sidewall; and a cover adapted to cover the fasteners when the fasteners are inserted into the attachment openings and the corresponding picket openings, wherein the cover is adapted to fit substantially within the channel, and wherein the overhang is adapted to extend over at least a portion of the cover; and a second rail configured to receive the second ends of the pickets.

9. The railing system of claim 8, wherein the attachment portion further comprises an enclosure for holding one or more accessories.

10. The railing system of claim 9, wherein the enclosure comprises an elongated slit opening.

11. The railing system of claim 8, wherein the attachment portion further comprises a second attachment sidewall in contact with another portion of the pickets.

12. The railing system of claim 11, wherein the attachment sidewall and the second attachment sidewall are arranged substantially parallel to each other.

* * * * *